US011286547B2

(12) United States Patent
Abe et al.

(10) Patent No.: US 11,286,547 B2
(45) Date of Patent: Mar. 29, 2022

(54) FERRITIC STAINLESS STEEL HAVING EXCELLENT SALT CORROSION RESISTANCE

(71) Applicant: NIPPON STEEL Stainless Steel Corporation, Tokyo (JP)

(72) Inventors: Masatoshi Abe, Tokyo (JP); Junichi Hamada, Tokyo (JP); Nobuhiko Hiraide, Tokyo (JP); Atsutaka Hayashi, Tokyo (JP)

(73) Assignee: NIPPON STEEL STAINLESS STEEL CORPORATION, Tokyo (JP)

( * ) Notice: Subject to any disclaimer, the term of this patent is extended or adjusted under 35 U.S.C. 154(b) by 22 days.

(21) Appl. No.: 16/966,426

(22) PCT Filed: Mar. 19, 2019

(86) PCT No.: PCT/JP2019/011516

§ 371 (c)(1),
(2) Date: Jul. 30, 2020

(87) PCT Pub. No.: WO2019/188601

PCT Pub. Date: Oct. 3, 2019

(65) Prior Publication Data

US 2021/0040590 A1 Feb. 11, 2021

(30) Foreign Application Priority Data

Mar. 30, 2018 (JP) ..... JP2018-067605

(51) Int. Cl.
*C22C 38/02* (2006.01)
*C22C 38/04* (2006.01)
(Continued)

(52) U.S. Cl.
CPC ..... *C22C 38/42* (2013.01); *C21D 8/005* (2013.01); *C21D 8/0226* (2013.01);
(Continued)

(58) Field of Classification Search
CPC ..... C22C 38/001; C22C 38/02; C22C 38/04; C22C 38/06; C22C 38/18; C22C 38/34; C22C 38/38
See application file for complete search history.

(56) References Cited

U.S. PATENT DOCUMENTS 5,843,240 A * 12/1998 Pedrazzini ..... C23G 1/086 134/3
6,398,876 B1 * 6/2002 Starcevic ..... C23G 1/086 134/3

(Continued)

FOREIGN PATENT DOCUMENTS

JP 3-90600 A 4/1991
JP 7-180001 A 7/1995

(Continued)

OTHER PUBLICATIONS

International Search Report for PCT/JP2019/011516 (PCT/ISA/210) dated May 28, 2019.

(Continued)

*Primary Examiner* — Adam Krupicka
(74) *Attorney, Agent, or Firm* — Birch, Stewart, Kolasch & Birch, LLP

(57) ABSTRACT

This ferritic stainless steel includes: in terms of % by mass, C: 0.001% to 0.100%; Si: 0.01% to 5.00%; Mn: 0.01% to 2.00%; P: 0.050% or less; S: 0.0100% or less; Cr: 9.0% to 25.0%; Ti: 0.001% to 1.00%; Al: 0.001% to 5.000%; and N: 0.001% to 0.050%, with a balance being Fe and impurities, wherein in a region from a steel surface to a depth of 5 nm, and not exceeding a thickness of a passive film, a total amount of Al and Si is 1.0 atomic % or more, an amount of Cr is 10.0 atomic % or more, and an amount of Fe is 85.0 atomic % or less, in terms of cation fraction.

7 Claims, 1 Drawing Sheet

(51) Int. Cl.

| | |
|---|---|
| ***C22C 38/42*** | (2006.01) |
| ***C21D 8/00*** | (2006.01) |
| ***C21D 8/02*** | (2006.01) |
| ***C22C 38/00*** | (2006.01) |
| ***C22C 38/44*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C22C 38/60*** | (2006.01) |

(52) U.S. Cl.

CPC ..... *C21D 8/0236* (2013.01); *C22C 38/005* (2013.01); *C22C 38/008* (2013.01); *C22C 38/02* (2013.01); *C22C 38/04* (2013.01); *C22C 38/44* (2013.01); *C22C 38/50* (2013.01); *C22C 38/52* (2013.01); *C22C 38/54* (2013.01); *C22C 38/58* (2013.01); *C22C 38/60* (2013.01); *C21D 2211/005* (2013.01)

(56) References Cited

U.S. PATENT DOCUMENTS

| | | | | |
|---|---|---|---|---|
| 6,554,908 | B1 * | 4/2003 | Negri | C23C 22/34 134/19 |
| 2013/0337289 | A1 | 12/2013 | Hatano et al. | |
| 2017/0073799 | A1 | 6/2017 | Nakamura et al. | |

FOREIGN PATENT DOCUMENTS

| | | | |
|---|---|---|---|
| JP | 2756190 | B2 | 5/1998 |
| JP | 2003-342797 | A | 12/2003 |
| JP | 2005-171338 | A | 6/2005 |
| JP | 4974542 | B2 | 7/2012 |
| JP | 5435179 | B2 | 3/2014 |
| JP | 5534119 | B1 | 6/2014 |
| KR | 10-2016-0143807 | A | 12/2016 |
| WO | WO 2012/124528 | A1 | 9/2012 |
| WO | WO 2014/103722 | A1 | 7/2014 |

OTHER PUBLICATIONS

Written Opinion of the International Searching Authority for PCT/JP2019/011516 (PCT/ISA/237) dated May 28, 2019.

Korean Office Action for Korean Application No. 10-2020-7021942, dated Jan. 3, 2022, with English translation.

* cited by examiner

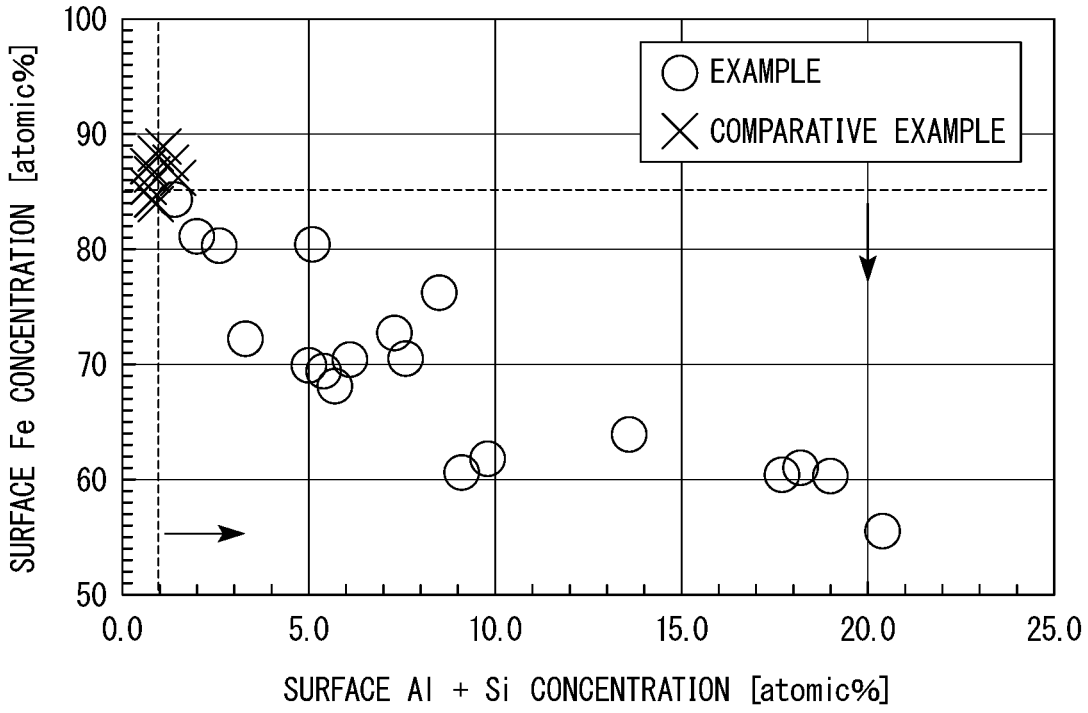
EXAMPLE
COMPARATIVE EXAMPLE
SURFACE Fe CONCENTRATION [atomic%]
100
90
80
70
60
50
0.0
5.0
10.0
15.0
20.0
25.0
SURFACE Al + Si CONCENTRATION [atomic%]

FERRITIC STAINLESS STEEL HAVING EXCELLENT SALT CORROSION RESISTANCE

TECHNICAL FIELD

The present invention relates to a ferritic stainless steel having excellent corrosion resistance against salt damage (salt corrosion resistance) used for applications requiring corrosion resistance against salt damage.

The present application claims priority on Japanese Patent Application No. 2018-067605 filed on Mar. 30, 2018, the content of which is incorporated herein by reference.

BACKGROUND ART

Examples of applications requiring corrosion resistance against salt damage include building materials, general furniture and home electrical appliances, fuel cells, automotive exhaust system parts, and other automotive parts. Examples of the automotive exhaust system parts include automotive mufflers, exhaust manifolds, center pipes, catalytic converters, EGR coolers, flexible pipes, and flanges. Examples of the other automotive parts include moldings, fuel filler pipes, battery parts (such as cases, cells, packs, and modules), and fastening parts (such as clamps and V-bands).

In recent years, demand for high corrosion resistance of a stainless steel has been further increased. For example, corrosion of automotive exhaust system parts is mainly caused from an inside of the exhaust system parts due to exhaust gas condensate water that is dew condensation water including dissolved exhaust gas. Recently, not only the corrosion resistance against corrosion from the inside, but also corrosion resistance against rust on an outside of the exhaust system parts caused by rainwater, muddy water, sea breeze, and the like are required.

In practice, when the automobile is checked from below a vehicle body at the time of delivering the automobile or making an inspection, rust on the outside of the exhaust system parts may be observed in some cases. Due to the rust, the number of cases of receiving complaints from users is increasing. Therefore, it is necessary to take measures against the rust on the outside of the exhaust system parts.

A stainless steel used for the automotive exhaust system parts is mainly a ferritic stainless steel in which an amount of Cr is relatively low. The ferritic stainless steel in which the amount of Cr is low does not have high corrosion resistance against rust on the outside of the exhaust system parts. However, in the case where a ferritic stainless steel in which the amount of Cr is high is used in order to enhance the corrosion resistance, this leads to an increase in cost. Therefore, there is a need to enhance the corrosion resistance of the ferritic stainless steel with an element cheaper than Cr.

In addition, since the automotive exhaust system parts are heated by high-temperature exhaust gas, an oxidized scale is generated on a surface. This oxidized scale reduces the corrosion resistance of the exhaust system parts. Then, the exhaust system parts may be corroded and an appearance thereof may be impaired in some cases. Therefore, a stainless steel having high corrosion resistance after heated is required.

Patent Document 1 discloses a ferritic stainless steel having excellent corrosion resistance against condensate water and low yield strength, and the ferritic stainless steel includes C: 0.05% by weight or less, Si: less than 0.10% by weight, Mn: 2.0% by weight or less, P: 0.05% by weight or less, S: 0.03% by weight or less, Cr: 11.0% to 23.0% by weight, Co: 0.01% to 3.0% by weight, N: 0.05% by weight or less, Al: 0.005% to 1.0% by weight, and one or more of B: 0.005% by weight or less, Ti: 0.05% to 1.0% by weight, Ta: 0.01% to 1.0% by weight, V: 0.05% to 1.0% by weight, and Zr: 0.01% to 1.0% by weight, with a balance being Fe and impurities. In Patent Document 1, the corrosion resistance against condensate water is improved while the yield strength is not increased by adding Co, but Patent Document 1 does not mention a surface film, and corrosion resistance against salt damage before and after heating.

Patent Document 2 discloses a ferritic stainless steel including, in terms of % by mass, C: 0.001 to 0.030%, Si: 0.03 to 0.80%, Mn: 0.05 to 0.50%, P: 0.03% or less, S: 0.01% or less, Cr: 19.0 to 28.0%, Ni: 0.01% or more and less than 0.30%, Mo: 0.2 to 3.0%, Al: more than 0.15% and 1.2% or less, V: 0.02% to 0.50%, Cu: less than 0.1%, Ti: 0.05 to 0.50%, N: 0.001 to 0.030%, and Nb: less than 0.05%, with a balance being Fe and impurities, in which the following Formula (1) is satisfied.

$$Nb \times P \leq 0.0005 \quad (1)$$

In Patent Document 2, the amounts of P and Nb are reduced to prevent the occurrence of welding cracks and ensure the corrosion resistance of a welded portion, but Patent Document 2 does not mention a passive film or a composition of a scale.

Patent Document 3 discloses a ferritic stainless steel including, in terms of % by mass, C: 0.001% to 0.030%, Si: 0.05% to 0.30%, Mn: 0.05% to 0.50%, P: 0.05% or less, S: 0.01% or less, Cr: 18.0% to 19.0%, Ni: 0.05% or more and less than 0.50%, Cu: 0.30% to 0.60%, N: 0.001% to 0.030%, Al: 0.10% to 1.50%, Ti: 0.05% to 0.50%, Nb: 0.002% to 0.050%, and V: 0.01% to 0.50%, with a balance being Fe and inevitable impurities, in which the following Formulas (1) and (2) are satisfied.

$$0.40 \leq Si + 1.5Al + 1.2Ti \leq 2.4 \quad (1)$$

$$0.60 \leq 1.2Nb + 1.7Ti + V + 2.2Al \quad (2)$$

In Patent Document 3, the corrosion resistance of the welded portion is achieved by defining the amounts of Si, Al, and Ti, but Patent Document 3 does not mention a passive film or a composition of a scale.

Patent Document 4 discloses a ferritic stainless steel including C: 0.015% by mass or less, Si: 0.5% by mass or less, Cr: 11.0% to 25.0% by mass, N: 0.020% by mass or less, Ti: 0.05% to 0.50% by mass, Nb: 0.10% to 0.50% by mass, and B: 0.0100% by mass or less, and further including, as necessary, one or more of Mo: 3.0% by mass or less, Ni: 2.0% by mass or less, Cu: 2.0% by mass or less, and Al: 4.0% by mass or less, in which when processed by uniaxial tension, a breaking elongation is 30% or more, and an $r_{min}$ value of Lankford values (r values) is 1.3 or more. in Patent Document 4, since a component composition is finely adjusted and the tensile properties are limited, the ferritic stainless steel sheet can be subjected to forming process under severe conditions, corrosion resistance can be maintained for a long time, and excellent impact resistance is also obtained. However, Patent Document 4 does not mention a passive film and a composition of a scale.

Patent Document 5 discloses an exhaust gas flow passage member for an automobile. The exhaust gas flow passage member for an automobile is formed by using, as a material, a ferritic stainless steel including C: 0.015% by mass or less, Si: 2.0% by mass or less, Mn: 1.0% by mass or less, P: 0.045% by mass or less, S: 0.010% by mass or less, Cr: 16% to 25% by mass, Nb: 0.05% to 0.2% by mass, Ti: 0.05% to 0.5% by mass, N: 0.025% by mass or less, Al: 0.02% to 1.0% by mass, and one or more of Ni: 0.1% to 2.0% by mass and Cu: 0.1% to 1.0% by mass, with a balance being Fe and impurities, in which Ni+Cu is 0.6% by mass or more. In Patent Document 5, a progress of pitting corrosion or crevice corrosion is effectively prevented by containing appropriate amounts of Ni and Cu, but Patent Document 5 does not mention a passive film and a composition of a scale.

In the related art, it was difficult to secure excellent corrosion resistance against salt damage in a ferritic stainless steel used for applications requiring the corrosion resistance against salt damage.

PRIOR ART DOCUMENTS

Patent Documents

Patent Document 1: Japanese Patent No. 2756190

Patent Document 2: Japanese Patent No. 5435179

Patent Document 3: Japanese Patent No. 5534119

Patent Document 4: Japanese Unexamined Patent Application, First Publication No. 2005-171338

Patent Document 5: Japanese Patent No. 4974542

Disclosure of Invention

Problems to be Solved by the Invention

The present invention has been made to solve such a problem, and an object thereof is to provide a ferritic stainless steel having excellent corrosion resistance against salt damage, when used for an application requiring corrosion resistance against salt damage.

Solutions for Solving the Problems

In order to solve the above-described problem, the present inventors have produced steel sheets containing Cr in various amounts and various elements, and have examined whether the corrosion resistance of a stainless steel could be improved by an element other than Cr, Ni, Mo, and Cu of which the effects of improving corrosion resistance are widely known. As a result, the present inventors have found that Al and Si particularly improve the corrosion resistance against salt damage and also improve the corrosion resistance after heating.

That is, the present invention has been completed based on the above-described findings, and the features of an aspect of the present invention for solving the above-described problem are as follows.

[1] A ferritic stainless steel having excellent corrosion resistance against salt damage, including: in terms of % by mass, C: 0.001% to 0.100%;
Si: 0.01% to 5.00%;
Mn: 0.01% to 2.00%;
P: 0.050% or less;
S: 0.0100% or less;
Cr: 9.0% to 25.0%;
Ti: 0.001% to 1.00%;
Al: 0.001% to 5.000%;
N: 0.001% to 0.050%;
Ni: 0% to 1.00%;
Mo: 0% to 3.00%;
Sn: 0% to 1.000%;
Cu: 0% to 2.00%;
B: 0% to 0.0050%;
Nb: 0% to 0.500%;
W: 0% to 1.000%;
V: 0% to 0.500%;
Sb: 0% to 0.100%;
Co: 0% to 0.500%;
Ca: 0% to 0.0050%;
Mg: 0% to 0.0050%;
Zr: 0% to 0.0300%;
Ga: 0% to 0.0100%;
Ta: 0% to 0.050%; and
REM: 0% to 0.100%, with a balance being Fe and impurities, wherein a passive film is present in a steel surface, and in a region ranging from the steel surface to a depth of 5 nm, and not exceeding a thickness of the passive film, Al and Si are present in a total amount of 1.0 atomic % or more, Cr is present in an amount of 10.0 atomic % or more, and Fe is present in an amount of 85.0 atomic % or less, in terms of cation fraction.

[2] The ferritic stainless steel having excellent corrosion resistance against salt damage according to [1], wherein after the ferritic stainless steel is subjected to a heat treatment at 400° C. for 8 hours in air, a concentrated layer of Al and Si is present at an interface between a base material and an oxide film at a volume ratio of 10% or more.

[3] The ferritic stainless steel having excellent corrosion resistance against salt damage according to [1] or [2], including: in terms of % by mass, one or more selected from the group consisting of:

Ni: 0.01% to 1.00%,
Mo: 0.01% to 3.00%,
Sn: 0.001% to 1.000%,
Cu: 0.01% to 2.00%,
B: 0.0001% to 0.0050%,
Nb: 0.001% to 0.500%,
W: 0.001% to 1.000%,
V: 0.001% to 0.500%,
Sb: 0.001% to 0.100%, and
Co: 0.001% to 0.500%.

[4] The ferritic stainless steel having excellent corrosion resistance against salt damage according to any one of [1] to [3], including: in terms of % by mass, one or more selected from the group consisting of:

Ca: 0.0001% to 0.0050%,
Mg: 0.0001% to 0.0050%,
Zr: 0.0001% to 0.0300%,
Ga: 0.0001% to 0.0100%,
Ta: 0.001% to 0.050%, and
REM: 0.001% to 0.100%.

Effects of Invention

According to an aspect of the present invention, it is possible to provide a ferritic stainless steel having excellent corrosion resistance against salt damage when used for an application requiring corrosion resistance against salt damage.

BRIEF DESCRIPTION OF DRAWINGS

FIG. 1 is a diagram showing a relationship between an Al+Si concentration and a Fe concentration in a steel sheet surface and results of a JASO-CCT test.

EMBODIMENTS FOR CARRYING OUT THE INVENTION

Hereinafter, embodiments of the present invention will be described in detail with reference to the drawing and tables.

In order to improve corrosion resistance against salt damage, present inventors have produced steels in which an amount of Cr and amounts of Al and Si were various values. Then, effects of a surface Al+Si concentration and a surface Fe concentration on the corrosion resistance against salt damage of the steel were examined. As a result, it was found that (1) Al and Si were also present in a passive film in a surface by increasing the amounts of Al and Si in the base material, (2) Al and Si greatly contributed to improvement of corrosion resistance, and (3) the corrosion resistance against salt damage was improved by an increase in surface Al+Si concentration (total concentration of Al and Si in the surface) and a decrease in surface Fe concentration. Results thereof are shown in FIG. 1 and Tables 1 to 4. In FIG. 1, a horizontal axis represents the surface Al+Si concentration represented by the cation fraction, and a vertical axis represents the surface Fe concentration represented by the cation fraction. Japanese Automobile Standards Organization Cyclic Corrosion Test (JASO-CCT test), which is a combined cycle test for investigating the corrosion resistance of a steel sheet for an automobile, was performed, and the steel sheet surface after the test was observed. As a criterion for the JASO-CCT test, a rating number was determined by a method based on JIS G 0595, and "3" was used as a boundary value. Steel types of which the rating number was in a range of 4 to 9 are indicated by a symbol "◎" (good) in FIG. 1 and Tables 3 and 4, and steel types of which the rating number was in a range of 0 to 3 are indicated by a symbol "×" (bad) in FIG. 1 and Tables 3 and 4.

TABLE 1

| | | Chemical composition (% by mass) | | | | | | | | | |
|---|---|---|---|---|---|---|---|---|---|---|---|
| | No. | C | Si | Mn | P | S | Cr | Ti | Al | N | Others |
| Invention Example | A1 | 0.006 | 0.42 | 0.35 | 0.022 | 0.0007 | 10.9 | 0.16 | 0.035 | 0.008 | |
| | A2 | 0.005 | 0.99 | 0.69 | 0.026 | 0.0046 | 13.4 | 0.24 | 1.956 | 0.003 | Ni: 0.24 |
| | A3 | 0.013 | 2.97 | 0.47 | 0.035 | 0.0021 | 24.4 | 0.39 | 1.324 | 0.012 | Co: 0.021 Ca: 0.0032 |
| | A4 | 0.006 | 1.59 | 0.15 | 0.044 | 0.0004 | 23.0 | 0.11 | 0.987 | 0.006 | Mo: 0.12 |
| | A5 | 0.004 | 0.48 | 0.38 | 0.001 | 0.0009 | 18.7 | 0.86 | 0.326 | 0.014 | Sb: 0.033 |
| | A6 | 0.056 | 4.96 | 1.24 | 0.041 | 0.0042 | 13.6 | 0.51 | 1.050 | 0.008 | Ta: 0.031 |
| | A7 | 0.033 | 1.37 | 0.98 | 0.023 | 0.0033 | 9.2 | 0.24 | 0.297 | 0.006 | Sn: 0.113 |
| | A8 | 0.004 | 0.98 | 1.54 | 0.020 | 0.0029 | 16.5 | 0.16 | 1.469 | 0.003 | W: 0.024 |
| | A9 | 0.007 | 3.57 | 1.11 | 0.043 | 0.0028 | 15.4 | 0.17 | 3.587 | 0.002 | Cu: 0.34 Zr: 0.0034 |
| | A10 | 0.081 | 1.98 | 0.49 | 0.012 | 0.0016 | 19.1 | 0.39 | 4.699 | 0.017 | V: 0.022 |
| | A11 | 0.002 | 0.98 | 0.98 | 0.006 | 0.0011 | 14.2 | 0.58 | 1.036 | 0.019 | B: 0.0026 Ga: 0.0044 |
| | A12 | 0.009 | 3.86 | 0.65 | 0.008 | 0.0009 | 17.9 | 0.44 | 2.047 | 0.003 | |
| | A13 | 0.006 | 0.95 | 0.30 | 0.028 | 0.0004 | 11.1 | 0.19 | 0.923 | 0.009 | Ni: 0.10 |
| | A14 | 0.005 | 0.96 | 0.30 | 0.029 | 0.0004 | 13.7 | 0.19 | 0.916 | 0.009 | Ni: 0.09 |
| | A15 | 0.006 | 0.94 | 0.30 | 0.028 | 0.0004 | 11.0 | 0.19 | 1.834 | 0.010 | V: 0.053 |
| | A16 | 0.005 | 1.00 | 0.30 | 0.028 | 0.0003 | 13.6 | 0.20 | 1.882 | 0.009 | B: 0.0005 |
| | A17 | 0.014 | 4.51 | 0.36 | 0.043 | 0.0007 | 21.1 | 0.19 | 2.561 | 0.011 | Nb: 0.013 Mg: 0.0022 |
| | A18 | 0.031 | 2.41 | 1.87 | 0.038 | 0.0034 | 22.6 | 0.68 | 1.526 | 0.012 | |
| | A19 | 0.025 | 0.75 | 1.32 | 0.029 | 0.0026 | 20.7 | 0.42 | 1.493 | 0.015 | REM: 0.038 |

TABLE 2

| | | Chemical composition (% by mass) | | | | | | | | | |
|---|---|---|---|---|---|---|---|---|---|---|---|
| | No. | C | Si | Mn | P | S | Cr | Ti | Al | N | Others |
| Comparative Example | B1 | 0.102 | 0.54 | 0.35 | 0.016 | 0.0019 | 10.8 | 0.27 | 0.268 | 0.008 | Co: 0.076 |
| | B2 | 0.036 | 0.00 | 0.69 | 0.025 | 0.0014 | 13.7 | 0.59 | 0.394 | 0.007 | Nb: 0.042 Ta: 0.011 |
| | B3 | 0.005 | 0.36 | 2.14 | 0.047 | 0.0025 | 15.6 | 0.28 | 1.674 | 0.016 | |
| | B4 | 0.009 | 0.19 | 0.58 | 0.053 | 0.0033 | 18.9 | 0.30 | 2.588 | 0.014 | W: 0.012 Ca: 0.0017 |

TABLE 2-continued

| No. | Chemical composition (% by mass) | | | | | | | | | |
|---|---|---|---|---|---|---|---|---|---|---|
| | C | Si | Mn | P | S | Cr | Ti | Al | N | Others |
| B5 | 0.018 | 1.54 | 1.69 | 0.023 | 0.0106 | 17.2 | 0.11 | 3.269 | 0.012 | Mg: 0.0027 |
| B6 | 0.074 | 1.68 | 0.97 | 0.017 | 0.0014 | 8.8 | 0.54 | 3.412 | 0.003 | REM: 0.006 |
| B7 | 0.003 | 3.49 | 0.25 | 0.029 | 0.0013 | 22.6 | 0.00 | 2.014 | 0.001 | V: 0.009 |
| B8 | 0.006 | 2.87 | 0.47 | 0.008 | 0.0028 | 23.9 | 0.63 | 0.000 | 0.005 | Sn: 0.082 |
| B9 | 0.025 | 4.66 | 0.15 | 0.005 | 0.0027 | 20.4 | 0.25 | 3.016 | 0.051 | B: 0.0044 Ga: 0.0049 |
| B10 | 0.021 | 0.03 | 0.06 | 0.036 | 0.0039 | 19.9 | 0.21 | 0.013 | 0.019 | |
| B11 | 0.014 | 0.06 | 0.98 | 0.027 | 0.0034 | 16.3 | 0.09 | 0.002 | 0.007 | Mo: 0.22 |
| B12 | 0.006 | 0.09 | 0.34 | 0.044 | 0.0026 | 18.2 | 0.17 | 0.026 | 0.006 | Cu: 0.55 |
| B13 | 0.003 | 0.15 | 0.11 | 0.027 | 0.0012 | 17.3 | 0.36 | 0.028 | 0.014 | Sb: 0.019 |
| B14 | 0.008 | 0.11 | 0.58 | 0.034 | 0.0009 | 14.5 | 0.84 | 0.041 | 0.011 | Ni: 0.35 Zr: 0.0029 |
| B15 | 0.019 | 0.08 | 0.12 | 0.039 | 0.0007 | 10.6 | 0.05 | 0.036 | 0.002 | |
| A1' | 0.006 | 0.42 | 0.35 | 0.022 | 0.0007 | 10.9 | 0.16 | 0.035 | 0.008 | |
| A13' | 0.006 | 0.95 | 0.30 | 0.028 | 0.0004 | 11.1 | 0.19 | 0.923 | 0.009 | Ni: 0.10 |
| A14' | 0.005 | 0.96 | 0.30 | 0.029 | 0.0004 | 13.7 | 0.19 | 0.916 | 0.009 | Ni: 0.09 |

*Underlined values represent values out of the range of the present invention.

TABLE 3

| | No. | Pickling condition: Added amount of sulfuric acid (g/L) | Pickling condition: Concentration of $Fe^{2+}$ in solution (%) | Cation fraction of surface Al + Si (atomic %) | Cation fraction of surface Cr (atomic %) | Cation fraction of surface Fe (atomic %) | Product surface corrosion test result | Volume ratio of concentrated layer of Al and Si after heat treatment (%) | Heat treated surface corrosion test result |
|---|---|---|---|---|---|---|---|---|---|
| Invention Example | A1 | 100 | 2.1 | 1.4 | 13.5 | 84.3 | ○ | 11.3 | ○ |
| | A2 | 80 | 3.6 | 8.5 | 14.4 | 76.2 | ○ | 15.9 | ○ |
| | A3 | 200 | 2.2 | 9.1 | 29.8 | 60.6 | ○ | 17.9 | ○ |
| | A4 | 130 | 1.7 | 5.7 | 25.8 | 68.1 | ○ | 13.5 | ○ |
| | A5 | 190 | 0.4 | 3.3 | 24.0 | 72.2 | ○ | 12.1 | ○ |
| | A6 | 220 | 4.3 | 13.6 | 21.9 | 63.9 | ○ | 23.1 | ○ |
| | A7 | 290 | 3.7 | 5.1 | 14.1 | 80.4 | ○ | 20.6 | ○ |
| | A8 | 100 | 4.0 | 7.3 | 19.1 | 72.7 | ○ | 14.0 | ○ |
| | A9 | 70 | 1.0 | 19.0 | 20.4 | 60.3 | ○ | 28.5 | ○ |
| | A10 | 150 | 1.3 | 18.2 | 20.6 | 61.0 | ○ | 24.6 | ○ |
| | A11 | 180 | 0.6 | 7.6 | 21.2 | 70.5 | ○ | 15.9 | ○ |
| | A12 | 270 | 0.3 | 17.7 | 21.2 | 60.4 | ○ | 28.4 | ○ |
| | A13 | 110 | 3.5 | 2.6 | 16.3 | 80.3 | ○ | 12.6 | ○ |
| | A14 | 100 | 2.8 | 5.4 | 24.3 | 69.4 | ○ | 16.7 | ○ |
| | A15 | 110 | 1.8 | 2.0 | 16.4 | 81.1 | ○ | 13.9 | ○ |
| | A16 | 100 | 0.9 | 6.1 | 23.1 | 70.4 | ○ | 17.9 | ○ |
| | A17 | 60 | 2.6 | 20.4 | 23.8 | 55.5 | ○ | 30.5 | ○ |
| | A18 | 290 | 3.1 | 9.8 | 28.2 | 61.8 | ○ | 20.1 | ○ |
| | A19 | 300 | 2.8 | 5.0 | 25.0 | 69.9 | ○ | 18.5 | ○ |

TABLE 4

| | No. | Pickling condition: Added amount of sulfuric acid (g/L) | Pickling condition: Concentration of $Fe^{2+}$ in solution (%) | Cation fraction of surface Al + Si (atomic %) | Cation fraction of surface Cr (atomic %) | Cation fraction of surface Fe (atomic %) | Product surface corrosion test result | Volume ratio of concentrated layer of Al and Si after heat treatment (%) | Heat treated surface corrosion test result |
|---|---|---|---|---|---|---|---|---|---|
| Comparative Example | B1 | 100 | 3.1 | 1.6 | 17.5 | 80.3 | x | 12.1 | x |
| | B2 | 190 | 0.5 | 1.1 | 16.7 | 81.4 | x | 11.2 | x |
| | B3 | 290 | 0.4 | 4.2 | 19.0 | 76.4 | x | 14.0 | x |
| | B4 | 240 | 3.8 | 7.9 | 21.5 | 70.0 | x | 21.1 | x |
| | B5 | 280 | 2.9 | 15.1 | 18.3 | 65.9 | x | 27.8 | x |
| | B6 | 100 | 1.7 | 16.6 | 11.8 | 70.8 | x | 29.5 | x |

TABLE 4-continued

| No. | Pickling condition: Added amount of sulfuric acid (g/L) | Pickling condition: Concentration of $Fe^{2+}$ in solution (%) | Cation fraction of surface Al + Si (atomic %) | Cation fraction of surface Cr (atomic %) | Cation fraction of surface Fe (atomic %) | Product surface corrosion test result | Volume ratio of concentrated layer of Al and Si after heat treatment (%) | Heat treated surface corrosion test result |
|---|---|---|---|---|---|---|---|---|
| B7 | 130 | 4.6 | 10.4 | 28.1 | 61.1 | x | 18.6 | x |
| B8 | 110 | 3.9 | 11.3 | 29.6 | 58.8 | x | 19.3 | x |
| B9 | 60 | 3.5 | 24.6 | 24.8 | 50.4 | x | 33.6 | x |
| B10 | 180 | 5.4 | 0.7 | 13.7 | 85.4 | x | 9.4 | x |
| B11 | 150 | 5.3 | 0.8 | 14.0 | 84.3 | x | 8.7 | x |
| B12 | 90 | 5.1 | 0.9 | 9.6 | 83.9 | x | 8.5 | x |
| B13 | 270 | 5.5 | 1.1 | 9.3 | 88.9 | x | 8.3 | x |
| B14 | 300 | 5.8 | 1.3 | 10.6 | 87.5 | x | 7.9 | x |
| B15 | 160 | 6.2 | 1.5 | 11.7 | 86.2 | x | 9.4 | x |
| A1' | 40 | 2.9 | 0.9 | 9.8 | 88.3 | x | 8.5 | x |
| A13' | 30 | 3.1 | 0.8 | 12.4 | 86.5 | x | 9.6 | x |
| A14' | 10 | 1.6 | 0.7 | 11.3 | 87.2 | x | 9.2 | x |

*Underlined values represent values out of the range of the present invention.

FIG. 1 shows that in the case where the surface Al+Si concentration is 1.0 atomic % or more in terms of cation fraction and the surface Fe concentration is 85.0 atomic % or less in terms of cation fraction, the corrosion resistance against salt damage improves.

As a result of observation of the steel sheet surface after the JASO-CCT test, it was found that, in a steel type having a high surface Al+Si concentration and a low surface Fe concentration, the number of pitting corrosion occurrences is small. Accordingly, it was found that Al and Si concentrated in the surface suppresses the occurrence of pitting corrosion, and it was also found that pitting corrosion is likely to occur in a steel type having a high surface Fe concentration.

Further, it was found that the number of flowed rust on a surface is small in a steel type having a high surface Al+Si concentration. Accordingly, it is found that a steel type having a high surface Al+Si concentration also suppresses the growth of pitting corrosion. It is considered that Al and Si are dissolved as ions inside the pitting corrosion at an initial stage of generation and are adsorbed on the surface of the steel sheet; and thereby, the growth of pitting corrosion is suppressed.

Further, as shown in Tables 1 to 4, it was found that the steel type having a high surface Al+Si concentration is also good in corrosion resistance against salt damage after a heat treatment to be described later.

Each steel type shown in Tables 1 to 4 was subjected to a heat treatment at 400° C. for 8 hours in the air, and then the JASO-CCT test was performed. The criteria for the JASO-CCT test were as described above.

As shown in Tables 1 to 4, it was found that, in the steel type having a high surface Al+Si concentration, after the heat treatment, a concentrated layer of Al and Si is present at an interface between a base material and an oxide film at a volume ratio of 10% or more, and corrosion resistance against salt damage is secured even in a harsh environment where Fe-rich oxide scale is present.

Hereinafter, a chemical composition of the steel defined in the present embodiment will be described in more detail. In addition, unless otherwise specified, in the present specification, "%" of an amount of element refers to "% by mass".

C: 0.001% to 0.100%

Since C reduces intergranular corrosion resistance and processability, an amount thereof needs to be kept low. Therefore, an upper limit of the amount of C is set to be 0.100% or less. However, in the case where the amount of C is excessively lowered, refining costs increase. Therefore, a lower limit of the amount of C is set to be 0.001% or more. A preferred range of the amount of C is 0.003% to 0.020%.

Si: 0.01% to 5.00%

Si is an important element in the present embodiment. Si is a very useful element that not only Si suppresses the generation of corrosion by being concentrated in a surface but also Si reduces a corrosion rate of the base material. Therefore, a lower limit of an amount of Si is set to be 0.01% or more. However, in the case where an excessive amount of Si is included, a reduction in elongation of the steel is caused and processability is degraded. Therefore, an upper limit of the amount of Si is set to be 5.00% or less. A preferred range of the amount of Si is 0.05% to 3.00%, and a more preferred range thereof is 0.10% to 2.00%.

Mn: 0.01% to 2.00%

Mn is useful as a deoxidizing element. However, in the case where an excessive amount of Mn is contained, corrosion resistance is degraded. Therefore, the amount of Mn is set to be in a range of 0.01% to 2.00%. A preferred range of the amount of Mn is 0.05% to 1.00%, and a more preferred range thereof is 0.10% to 0.70%.

P: 0.050% or less

P is an element that deteriorates processability and weldability. Therefore, an amount thereof needs to be limited. Therefore, the amount of P is set to be 0.050% or less. However, in the case where the amount of P is reduced more than necessary, manufacturing costs increase. Therefore, a lower limit of the amount of P is preferably 0.001% or more. A more preferred range of the amount of P is 0.005% or more and 0.030% or less.

S: 0.0100% or less

S is an element that deteriorates corrosion resistance. Therefore, an amount thereof needs to be limited. Therefore, the amount of S is set to be 0.0100% or less. However, in the case where the amount of S is reduced more than necessary, manufacturing costs increase. Therefore, a lower limit of the amount of S is preferably 0.0001% or more. A more preferred range of the amount of S is 0.0003% or more and 0.0050% or less.

Cr: 9.0% to 25.0%

Cr needs to be contained in an amount of 9.0% or more, in order to secure corrosion resistance in a salt damage environment. As the amount of Cr increases, the corrosion resistance improves, but the processability and manufacturability are degraded. Therefore, an upper limit of the amount of Cr is set to be 25.0% or less. A preferred range of the amount of Cr is 10.0% to 23.0%, and a more preferred range thereof is 10.5% to 20.0%.

Ti: 0.001% to 1.00%

Ti needs to be contained in an amount of 0.001% or more, in order to prevent sensitization of a stainless steel. However, in the case where a large amount of Ti is included, alloy costs increase. Therefore, an upper limit of the amount of Ti is set to be 1.00%. A preferred range of the Ti amount is 0.050% to 0.70%, and a more preferred range thereof is 0.100% to 0.50%.

Al: 0.001% to 5.000%

Al is an important element in the present embodiment. Al is a very useful element because the not only Al suppresses the generation of corrosion by being concentrated in a surface but also Al reduces a corrosion rate of the base material. Therefore, a lower limit of an amount of Al is set to be 0.001% or more. However, in the case where an excessive amount of Al is contained, a reduction in elongation of a material is caused and processability is degraded. Therefore, an upper limit of the amount of Al is set to be 5.000% or less. A preferred range of the amount of Al is 0.050% to 3.000%, and a more preferred range thereof is 0.100% to 2.000%.

N: 0.001% to 0.050%

N is an element useful for pitting corrosion resistance, but N degrades intergranular corrosion resistance and processability. Therefore, an amount of N needs to be kept low. Therefore, an upper limit of the amount of N is set to be 0.050% or less. The upper limit of the amount of N is preferably 0.030% or less. A lower limit of the amount of N is 0.001% or more.

A basic chemical composition of the ferritic stainless steel of the present embodiment is as described above. In the present embodiment, the following elements can be further contained as needed.

One or more of Ni, Mo, Sn, Cu, B, Nb, W, V, Sb, and Co may be contained depending on a purpose. Lower limits of amounts of these elements are 0% or more, and preferably more than 0%.

Ni: 0.01% to 1.00%

Ni can be contained in an amount of 0.01% or more, in order to improve corrosion resistance. However, in the case where a large amount of Ni is included, alloy costs increase. Therefore, an upper limit of the amount of Ni is set to be 1.00%. A preferred range of the amount of Ni is 0.02% to 0.70%.

Mo: 0.01% to 3.00%

Mo can be contained in an amount of 0.01% or more, in order to improve corrosion resistance. However, in the case where an excessive amount of Mo is included, processability is degraded and in addition, costs increase because Mo is expensive. Therefore, an upper limit of the amount of Mo is set to be 3.00% or less. A preferred range of the amount of Mo is 0.05% to 2.00%.

Sn: 0.001% to 1.000%

Sn can be contained in an amount of 0.001% or more, in order to improve corrosion resistance. However, in the case where an excessive amount of Sn is included, costs increase. Therefore, an upper limit of the amount of Sn is set to be 1.000% or less. A preferred range of the amount of Sn is 0.005% to 0.700%.

Cu: 0.01% to 2.00%

Cu can be contained in an amount of 0.01% or more, in order to improve corrosion resistance. However, in the case where an excessive amount of Cu is included, costs increase. Therefore, an upper limit of the amount of Cu is set to be 2.00% or less. A preferred range of the amount of Cu is 0.20% to 1.00%.

B: 0.0001% to 0.0050%

B is an element useful for improving secondary processability (secondary processing properties), and B can be contained in an amount of 0.0050% or less. In order to stably obtain the effects, a lower limit of the amount of B is set to be 0.0001% or more. A preferred range of the amount of B is 0.0005% to 0.0040%.

Nb: 0.001% to 0.500%

Nb is useful for improving high-temperature strength and improving intergranular corrosion resistance of a welded portion. However, in the case where an excessive amount of Nb is included, processability and manufacturability are degraded. Therefore, the amount of Nb is set to be in a range of 0.001% to 0.500%. A preferred range of the amount of Nb is 0.010% to 0.400%.

W: 0.001% to 1.000%

W can be contained in an amount of 1.000% or less, in order to improve corrosion resistance. In order to stably obtain the effects, a lower limit of the amount of W is set to be 0.001% or more. A preferred range of the amount of W is 0.010% to 0.800%.

V: 0.001% to 0.500%

V can be contained in an amount of 0.500% or less, in order to improve corrosion resistance. In order to stably obtain the effects, a lower limit of the amount of V is set to be 0.001% or more. A preferred range of the amount of V is 0.005% to 0.300%.

Sb: 0.001% to 0.100%

Sb can be contained in an amount of 0.100% or less, in order to improve general corrosion resistance. In order to stably obtain the effects, a lower limit of the amount of Sb is set to be 0.001% or more. A preferred range of the amount of Sb is 0.010% to 0.080%.

Co: 0.001% to 0.500%

Co can be contained in an amount of 0.500% or less, in order to improve secondary processability and toughness. In order to stably obtain the effects, a lower limit of the amount of Co is set to be 0.001% or more. A preferred range of the amount of Co is 0.010% to 0.300%.

A total amount of one or more of Ni, Mo, Sn, Cu, B, Nb, W, V, Sb, and Co is preferably 10% or less from the viewpoint of increase in cost and the like.

One or more of Ca, Mg, Zr, Ga, Ta, and REM may be contained depending on a purpose. Lower limits of amounts of these elements are 0% or more, and preferably more than 0%.

Ca: 0.0001% to 0.0050%

Ca is contained for desulfurization. However, in the case where an excessive amount of Ca is contained, water-soluble inclusions of CaS are generated to degrade corrosion resistance. Therefore, Ca can be contained in an amount of 0.0001% to 0.0050%. A preferred range of the amount of Ca is 0.0005% to 0.0030%.

Mg: 0.0001% to 0.0050%

Mg minimizes the structure and Mg is also useful for improving processability and toughness. Therefore, Mg can be contained in an amount of 0.0050% or less. In order to stably obtain the effects, a lower limit of the amount of Mg is set to be 0.0001% or more. A preferred range of the amount of Mg is 0.0005% to 0.0030%.

Zr: 0.0001% to 0.0300%

Zr can be contained in an amount of 0.0300% or less, in order to improve corrosion resistance. In order to stably obtain the effects, a lower limit of the amount of Zr is set to be 0.0001% or more. A preferred range of the amount of Zr is 0.0010% to 0.0100%.

Ga: 0.0001% to 0.0100%

Ga can be contained in an amount of 0.0100% or less, in order to improve corrosion resistance and hydrogen embrittlement resistance. In order to stably obtain the effects, a lower limit of the amount of Ga is set to be 0.0001% or more. A preferred range of the amount of Ga is 0.0005% to 0.0050%.

Ta: 0.001% to 0.050%

Ta can be contained in an amount of 0.050% or less, in order to improve corrosion resistance. In order to stably obtain the effects, a lower limit of the amount of Ta is set to be 0.001% or more. A preferred range of the amount of Ta is 0.005% to 0.030%.

REM: 0.001% to 0.100%

REM is an element useful for refining because REM has a deoxidizing effect and the like. Therefore, REM can be contained in an amount of 0.100% or less. In order to stably obtain the effects, a lower limit of the amount of REM is set to be 0.001% or more. A preferred range of the amount of REM is 0.003% to 0.050%.

REM (rare earth element) is a generic term including two elements that are scandium (Sc) and yttrium (Y), and 15 elements (lanthanoids) from lanthanum (La) to lutetium (Lu), according to a general definition. REM is at least one selected from these rare earth elements, and the amount of REM is a total amount of rare earth elements.

Next, a surface component according to the present embodiment will be described.

The surface component of the ferritic stainless steel of the present embodiment satisfies the following requirements.

The ferritic stainless steel of the present embodiment includes a passive film in the steel surface, and in a region ranging from the steel surface to a depth of 5 nm (a region not exceeding a thickness of the passive film), Al and Si are present in a total amount of 1.0 atomic % or more, Cr is present in an amount of 10.0 atomic % or more, and Fe is present in an amount of 85.0 atomic % or less, in terms of cation fraction. The thickness of the passive film is preferably 10 nm or less. The thickness of the passive film may be 5 nm or less in some cases. In this case, a range where the cation fraction is measured is set to be a region that does not exceed the thickness of the passive film from the steel surface. The composition of each element in the passive film is obtained by measuring a spectrum of the steel surface using Auger electron spectroscopy and calculating the composition from a peak intensity of each element. In addition, the passive film includes a balance (such as inclusions and the like) other than Al, Si, Fe, and Cr. The cation fraction in the present embodiment refers to a proportion relative to 100 atomic % of a total amount of Al, Si, Fe, Cr, and the balance (a total amount of cation elements (elements that form stable cations)) contained in a region up to a depth of 5 nm from the surface of the passive film.

In the ferritic stainless steel of the present embodiment, a concentrated layer of Al and Si is present at an interface between a base material and an oxide film at a volume ratio of 10% or more after the ferritic stainless steel is subjected to a heat treatment at 400° C. for 8 hours in air. Therefore, the ferritic stainless steel of the present embodiment secures corrosion resistance against salt damage even in a harsh environment where Fe-rich oxide scale is present.

In a method of manufacturing the ferritic stainless steel of the present embodiment, a general method of manufacturing a steel sheet consisting of a ferritic stainless steel is basically applied. For example, molten steel having the chemical composition described above is obtained in a converter or an electric furnace, and is refined in an AOD furnace, a VOD furnace, or the like. Thereafter, a steel slab is obtained by a continuous casting method or an ingot casting method. Then, the steel slab is subjected to the steps of hot rolling, annealing of a hot rolled sheet, pickling, cold rolling, finish annealing, and pickling Thereby, the ferritic stainless steel of the present embodiment is manufactured. The annealing of the hot-rolled sheet may be omitted, and the cold rolling, finish annealing, and pickling may be repeatedly performed. Surface grinding may be performed between respective steps.

However, in order to form the passive film in the surface containing Al and Si, which is the most important point of the present embodiment, it is necessary to pay attention to pickling conditions of the cold-rolled annealed sheet. Specifically, pickling is performed in a solution containing 50 g/L or more of sulfuric acid and 10 g/L or more of nitric acid or sodium nitrate. The solution may further contain sulfuric acid, sodium sulfate, hydrofluoric acid, sodium silicofluoride, hydrochloric acid, and the like as appropriate. Further, the acids may be present in the same solution, or each acid may be put into a separate tank to sequentially perform the pickling by each acid. In the case where each acid is put into a separate tank to sequentially perform the pickling by each acid, the order of using the acid is not particularly limited, and may be any order. The pickling method may be electrolytic pickling or pickling by only immersion. The amount of sulfuric acid is desirably 80 g/L or more, and more desirably 100 g/L or more. The amount of nitric acid or sodium nitrate is desirably 15 g/L or more, and more desirably 20 g/L or more. In addition, a concentration of $Fe^{2+}$ in the pickling solution is set to be 5.0% or less. The concentration of $Fe^{2+}$ in the pickling solution is desirably 3.0% or less. Total pickling time is set to be 3 seconds or more.

By performing the above-described pickling, it becomes possible to remove oxides of Al and Si which are difficult to be removed by ordinary pickling. Thereby, a passive film is formed which contains Al and Si, is uniform, and has few defects. In the case where the above-described pickling conditions are not satisfied, oxides of Al and Si remain on the surface to form gaps or the like, and these serve as corrosion starting points. Also, in the case where the concentration of $Fe^{2+}$ in the solution is high, oxides of Al and Si remain on the surface.

EXAMPLES

The following experiment was performed to confirm effects of the present invention in detail. This example shows one embodiment of the present invention, and the present invention is not limited to the following configuration.

Steels having compositions shown in Tables 1 and 2 were melted, hot rolling was performed until a sheet thickness became 4 mm, annealing was performed at 900° C. for 1 minute, and then pickling was performed.

Thereafter, cold rolling was performed until the sheet thickness became 1.2 mm, annealing was performed at 870° C. for 1 minute, and then pickling was performed.

The pickling was performed in a solution in which a concentration of sulfuric acid was 10 to 300 g/L and a concentration of sodium nitrate was 30 g/L. That is, under the conditions where the concentration of sodium nitrate was kept constant and only the concentration of sulfuric acid was changed, the change in the composition of the passive film in the surface was examined. In addition, $FeSO_4$ was included in the solution, and the influence of the concentration of $Fe^{2+}$ was examined.

A test piece having a width of 75 mm and a length of 150 mm was cut out from the prepared steel sheet and was used as a test piece for a JASO-CCT test. The JASO-CCT test was performed for 12 cycles in accordance with JASO M 610-92.

As a criterion for the JASO-CCT test, a rating number was determined by a method based on JIS G 0595, and "3" was used as a boundary value. Steel types of which the rating number was 4 to 9 are indicated by a symbol "◎" (good) in FIG. 1 and Tables 3 and 4, and steel types of which the rating number was 0 to 3 are indicated by a symbol "×" (bad) in FIG. 1 and Tables 3 and 4. In addition, in Tables 3 and 4, these evaluation results are shown in the column of "Product surface corrosion test result" (corrosion test result of steel surface not subjected to heat treatment).

In the prepared steel sheet, a spectrum of the steel surface was measured by Auger electron spectroscopy, and a composition (cation fraction) of each element in the passive film was determined from the peak intensity of each element. The cation fraction was measured in a region ranging from the steel surface to a depth of 5 nm (however, a region not exceeding the thickness of the passive film).

As shown in Tables 1 to 4, in Invention Examples, the surface Al+Si concentration was 1.0 atomic % or more in terms of cation fraction, the surface Cr concentration was 10.0 atomic % or more, and the surface Fe concentration was 85.0 atomic % or less in terms of cation fraction. In Invention Examples, it was found that the rating number was 4 to 9, and the evaluation was "◎" (good).

On the other hand, in comparative examples, the surface Al+Si concentration, the surface Cr concentration, or the surface Fe concentration in terms of a steel component or the cation fraction was out of the range of the present embodiment. In comparative examples, it was found that the rating number was 0 to 3 and the evaluation was "×" (bad). In Comparative Examples B10 to B15, the concentration of $Fe^{2+}$ in the acid (the pickling solution) was more than 5.0%. In Comparative Examples B10 to B15, even though the steel component was within the range of the present embodiment, the surface Al+Si concentration, the surface Cr concentration, or the surface Fe concentration in terms of the cation fraction was out of the range of the present embodiment, and the evaluation result was "×" (bad). In Comparative Examples A1', A13', and A14', the amount of $H_2SO_4$ in the solution (the pickling solution) was less than 50 g/L. In Comparative Examples A1', A13', and A14', even though the steel component was within the range of the present embodiment, the surface Al+Si concentration, the surface Cr concentration, or the surface Fe concentration in terms of cation fraction was out of the range of the present embodiment, and the evaluation result was "×" (bad). Under the pickling conditions of Comparative Examples A1', A13', and A14', in the case where the amount of $H_2SO_4$ in the solution (pickling solution) was 50 g/L or more and the total pickling time was shorter than 3 seconds, even though the steel component was within the range of the present embodiment, the surface Al+Si concentration, the surface Cr concentration, and the surface Fe concentration in terms of cation fraction were out of the ranges of the present embodiment, and the evaluation result was "×" (bad).

Further, a test piece having a width of 75 mm and a length of 150 mm was cut out from the prepared steel sheet, and the test piece was subjected to a heat treatment at 400° C. for 8 hours in the air. Then, the heat-treated steel sheet was used as a test piece for a JASO-CCT test. The JASO-CCT test was performed for 12 cycles in accordance with JASO M 610-92. The criterion was the same as described above. In Tables 3 and 4, these evaluation results are shown in the column of "Heat treated surface corrosion test result" (corrosion test result of steel surface subjected to heat treatment).

In addition, a cross-sectional surface of the test piece subjected to the heat treatment at 400° C. for 8 hours in the air was observed. Using a focused ion beam (FIB) apparatus, a test piece for a cross-sectional observation having a size of 7 mm×4 mm was cut out from the heat-treated test piece so that an interface between the base material and the oxide film could be observed. Using a transmission electron microscope and an energy dispersive X-ray analyzer (EDS), the composition of the interface between the base material and the oxide film of the test piece for cross-sectional observation was analyzed, and a photograph of an appearance of the interface between the base material and the oxide film was photographed. In particular, since the color of the concentrated layer of Al and Si was different in the transmission electron microscope image, image analysis was performed to determine a volume ratio of the concentrated layer of Al and Si. Regarding the volume ratio of the concentrated layer of Al and Si, the volume ratio of the concentrated layer of Al and Si was determined in each of three visual fields of 600 nm×600 nm, and an average value thereof was calculated.

As shown in Tables 1 to 4, it was found that the steel type having a high surface Al+Si concentration in terms of cation fraction included the concentrated layer of Al and Si at the interface between the base material and the oxide film at a volume ratio of 10% or more after the heat treatment, and even in a severe environment in which a Fe rich oxide scale was present, the rating number was 4 to 9, and the evaluation was "◎" (good). On the other hand, it was found that in the case were the component composition, the surface Al+Si concentration, or the surface Fe concentration in terms of the cation fraction was out of the range of the present embodiment, the rating number was 0 to 3 and the evaluation was "×" (bad).

Industrial Applicability

The ferritic stainless steel having excellent corrosion resistance against salt damage of the present embodiment is suitable as a member used for an application requiring corrosion resistance against salt damage. Examples of the applications requiring the corrosion resistance against salt damage include building materials, general furniture and home electrical appliances, fuel cells, automotive exhaust system parts, and other automotive parts. Examples of the automotive exhaust system parts include automotive mufflers, exhaust manifolds, center pipes, catalytic converters, EGR coolers, flexible pipes, and flanges. Examples of the other automotive parts include moldings, fuel filler pipes, battery parts (such as cases, cells, packs, and modules), and fastening parts (such as clamps and V-bands).

The invention claimed is:

1. A ferritic stainless steel having excellent corrosion resistance against salt damage, comprising: in terms of % by mass, C: 0.001% to 0.100%;

Si: 0.01% to 5.00%;

Mn: 0.01% to 2.00%;

P: 0.050% or less;

S: 0.0100% or less;

Cr: 9.0% to 25.0%;
Ti: 0.001% to 1.00%;
Al: 1.050% to 5.000%;
N: 0.001% to 0.050%;
Ni: 0% to 1.00%;
Mo: 0% to 3.00%;
Sn: 0% to 1.000%;
Cu: 0% to 2.00%;
B: 0% to 0.0050%;
Nb: 0% to 0.500%;
W: 0% to 1.000%;
V: 0% to 0.500%;
Sb: 0% to 0.100%;
Co: 0% to 0.500%;
Ca: 0% to 0.0050%;
Mg: 0% to 0.0050%;
Zr: 0% to 0.0300%;
Ga: 0% to 0.0100%;
Ta: 0% to 0.050%; and
REM: 0% to 0.100%,
with a balance being Fe and impurities,
wherein a passive film is present in a steel surface, and in a region ranging from the steel surface to a depth of 5 nm, and not exceeding a thickness of the passive film, Al and Si are present in a total amount of 1.0 atomic % or more, Cr is present in an amount of 10.0 atomic % or more, and Fe is present in an amount of 85.0 atomic % or less, in terms of cation fraction.

2. The ferritic stainless steel having excellent corrosion resistance against salt damage according to claim 1,
wherein after the ferritic stainless steel is subjected to a heat treatment at 400° C. for 8 hours in air, a concentrated layer of Al and Si is present at an interface between a base material and an oxide film at a volume ratio of 10% or more.

3. The ferritic stainless steel having excellent corrosion resistance against salt damage according to claim 1, comprising: in terms of % by mass, one or more selected from the group consisting of:
Ni: 0.01% to 1.00%,
Mo: 0.01% to 3.00%,
Sn: 0.001% to 1.000%,
Cu: 0.01% to 2.00%,
B: 0.0001% to 0.0050%,
Nb: 0.001% to 0.500%,
W: 0.001% to 1.000%,
V: 0.001% to 0.500%,
Sb: 0.001% to 0.100%, and
Co: 0.001% to 0.500%.

4. The ferritic stainless steel having excellent corrosion resistance against salt damage according to claim 1, comprising: in terms of % by mass, one or more selected from the group consisting of:
Ca: 0.0001% to 0.0050%,
Mg: 0.0001% to 0.0050%,
Zr: 0.0001% to 0.0300%,
Ga: 0.0001% to 0.0100%,
Ta: 0.001% to 0.050%, and
REM: 0.001% to 0.100%.

5. The ferritic stainless steel having excellent corrosion resistance against salt damage according to claim 2, comprising: in terms of % by mass, one or more selected from the group consisting of:
Ni: 0.01% to 1.00%,
Mo: 0.01% to 3.00%,
Sn: 0.001% to 1.000%,
Cu: 0.01% to 2.00%,
B: 0.0001% to 0.0050%,
Nb: 0.001% to 0.500%,
W: 0.001% to 1.000%,
V: 0.001% to 0.500%,
Sb: 0.001% to 0.100%, and
Co: 0.001% to 0.500%.

6. The ferritic stainless steel having excellent corrosion resistance against salt damage according to claim 2, comprising: in terms of % by mass, one or more selected from the group consisting of:
Ca: 0.0001% to 0.0050%,
Mg: 0.0001% to 0.0050%,
Zr: 0.0001% to 0.0300%,
Ga: 0.0001% to 0.0100%,
Ta: 0.001% to 0.050%, and
REM: 0.001% to 0.100%.

7. The ferritic stainless steel having excellent corrosion resistance against salt damage according to claim 3, comprising: in terms of % by mass, one or more selected from the group consisting of:
Ca: 0.0001% to 0.0050%,
Mg: 0.0001% to 0.0050%,
Zr: 0.0001% to 0.0300%,
Ga: 0.0001% to 0.0100%,
Ta: 0.001% to 0.050%, and
REM: 0.001% to 0.100%.

* * * * *